US007336240B2

(12) United States Patent
Yukl

(10) Patent No.: US 7,336,240 B2
(45) Date of Patent: Feb. 26, 2008

(54) INTEGRATED MICROWAVE TRANSCEIVER TILE STRUCTURE

(75) Inventor: Tex Yukl, Juliaetta, ID (US)

(73) Assignee: EMIT Technologies, L.L.C., Seattle, WA (US)

( * ) Notice: Subject to any disclaimer, the term of this patent is extended or adjusted under 35 U.S.C. 154(b) by 345 days.

(21) Appl. No.: 11/220,951

(22) Filed: Sep. 6, 2005

(65) Prior Publication Data

US 2006/0028389 A1 Feb. 9, 2006

Related U.S. Application Data

(63) Continuation of application No. 10/963,183, filed on Oct. 12, 2004, now Pat. No. 6,987,491.

(60) Provisional application No. 60/511,536, filed on Oct. 15, 2003.

(51) Int. Cl.
*H01Q 21/00* (2006.01)

(52) U.S. Cl. ..... 343/853; 343/700 MS

(58) Field of Classification Search ..... 343/700 MS, 343/853, 850, 824, 893
See application file for complete search history.

(56) References Cited

U.S. PATENT DOCUMENTS 3,858,221 A * 12/1974 Harrison et al. ..... 343/815
4,912,481 A * 3/1990 Mace et al. ..... 343/700 MS
4,937,585 A * 6/1990 Shoemaker ..... 343/700 MS
6,166,705 A * 12/2000 Mast et al. ..... 343/853

FOREIGN PATENT DOCUMENTS

WO WO02/23672 A 3/2002

OTHER PUBLICATIONS

Norvell et al., Mar. 6, 1999 "Micro electro mechanical switch (MEMS) technology applied to electronically scanned arrays for space based radar" Aerospace Conference, 1999, IEEE, Proceedings vol. 3, pp. 239-247.

Wang et al, Jun. 21, 1998, "Low-Profile, Integrated Radiator Tiles for Wideband Circular-Polarized Phased Array Applications", IEEE Antennas and Propagation Society International Symposium 1998 Digest vol. 2.

* cited by examiner

*Primary Examiner*—Hoang V. Nguyen
(74) *Attorney, Agent, or Firm*—Jon M. Dickinson, PC; Robert D. Varitz, PC

(57) ABSTRACT

Integrated microwave modular transceiver tile structure in the form of a cube-like configuration, and including (a) a first, generally planar, circuit-board layer structure possessing an array of plural, integrally formed microwave transceivers arranged in a defined row-and-column pattern, with each transceiver having an associated transceiver axis extending generally normal to the plane of said the first layer structure, and (b) a second, generally planar, circuit-board layer structure including transceiver-function operational circuitry operatively connected to the transceivers, and functional to promote operation of the transceivers simultaneously in transmission and reception modes of operation.

6 Claims, 3 Drawing Sheets

INTEGRATED MICROWAVE TRANSCEIVER TILE STRUCTURE

CROSS REFERENCE TO RELATED APPLICATION

This application is a continuation of U.S. patent application Ser. No. 10/963,183, filed Oct. 12, 2004, now U.S. Pat. No. 6,987,491, for "Integrated Microwave Transceiver Tile Structure" which claims priority to U.S. Provisional Patent Application Ser. No. 60/511,536, filed Oct. 15, 2003 entitled "Integrated Microwave Transceiver Tile Structure". The entire disclosure contents of those two patent applications are hereby incorporated herein by reference.

Reference to, and Incorporation by Reference of, Additional Prior Patents and Patent Application In the present specification, references are variously made to interesting background information relevant to the present invention, and contained in different ones of the following, listed (a) U.S. Patents, and (b) single, currently pending U.S. Regular patent application:

U.S. Pat. No. 4,234,844 for "Electromagnetic Noncontacting Measuring Apparatus";

U.S. Pat. No. 4,318,108 for "Bidirectionally Focusing Antenna";

U.S. Pat. No. 4,532,939 for "Noncontacting, Hyperthermia Method and Apparatus for Destroying Living Tissue in Vivo";

U.S. Pat. No. 4,878,059 for "Farfield/Nearfield Transmission/Reception Antenna";

U.S. Pat. No. 4,912,982 for "Non-Perturbing Cavity Method and Apparatus for Measuring Certain Parameters of Fluid Within a Conduit";

U.S. Pat. No. 4,947,848 for "Dielectric-Constant Change Monitoring";

U.S. Pat. No. 4,949,094 for "Nearfield/Farfield Antenna with Parasitic Array";

U.S. Pat. No. 4,975,968 for "Timed Dielectrometry Surveillance Method and Apparatus";

U.S. Pat. No. 5,083,089 for "Fluid Mixture Ratio Monitoring Method and Apparatus";

U.S. Pat. No. 6,057,761 for "Security System and Method"; and patent application Ser. No. 10/304,388, filed Nov. 25, 2002 by Tex Yukl for "Dielectric Personnel Scanning".

All of these prior documents contain useful information, and accordingly the entireties of the disclosure contents of these several patents, and of the single mentioned U.S. patent application, are hereby incorporated herein by reference.

BACKGROUND AND SUMMARY OF THE INVENTION

The present invention relates to a self-contained, compact transceiver tile structure, or tile, which is employable in and with respect to a system, apparatus, and methodology involving dielectric microwave scanning of a human subject, and in particular, to such scanning which is done for the purpose of detecting, in relation to baseline physiologic response data, and according to defined screening criteria, notable differences, or anomalies, in relation to a given individual's "dielectric signature". Put in another way, the transceiver tile structure of this invention is especially suited for use in a substance-scanning environment (a dielectric scanning environment) wherein the contained transceivers, and their supporting operational circuitry, are constructed to perform substance-scanning differentiation between physiology (human physiology) and non-physiology. The term "transceiver" is used herein with a definition which refers to a device which simultaneously transmits and receives signals.

While there are many substance-scanning (or screening) applications in which the integrated transceiver tile structure of this invention finds substantial practical utility, two specific such applications are particularly noted herein, and one of these is employed as a principal model for discussing and explaining the structure and operation of this invention. These two applications include (a) security detection, or scanning (screening), at locations such as airports for the purpose of detecting weapons, contraband, etc., and (b) authorized access control for personnel in sensitive areas, for example, in relation to research and development areas within a business. Many other useful applications will come to mind to those generally skilled in the art.

A preferred embodiment of the tile of the present invention is described herein in relation to a scanning system which departs from, and offers certain improvements over, a like, predecessor system and methodology that are fully illustrated and described in above-mentioned U.S. Pat. No. 6,057,761. These improvements, which exist in certain areas involving both mechanical and electrical aspects of the previously illustrated scanning process and structure per se, result in the present invention having certain preferential utility in particular applications, such as in applications involving airport-security screening areas, where a very efficient, high throughput of people needs to be accommodated without compromising scanning resolution and effectiveness. In terms of how scanned data is ultimately read (monitored and evaluated based upon the operation of the tile structure of this invention) to detect dielectric anomalies that are important to detect, substantially the same technology which is described in the just-mentioned '761 patent is also employed, for the most part, in the improved system version which is disclosed in this document.

By way of further background, and regarding the dielectric scanning (or screening) process which is implemented by the tile structure of the present invention, as a general statement respecting the relevant physics, all materials have what is known as a dielectric constant which is associated with their physical, electrical (electromagnetic and electrostatic) properties. As a consequence, when exposed to different wavelengths and frequencies of microwave radiation, each material produces a reflection reaction, or response, to that radiation, which response, in nature, is uniquely related, among other things, to the particular material's respective dielectric constant. By subjecting a material to controlled, transmitted, microwave energy, it is possible to interpret a material's reflection "response" thereto in terms of its dielectric constant. The term "dielectric signature" is employed herein to refer to this phenomenon.

Where plural, different characters of materials are closely united in a selected volume of space, microwave radiation employed to observe and detect the "dielectric signature" of that "space" will elicit a response which is based upon an averaging phenomenon in relation to the respective dielectric-constant contributions which are made in that space by the respective, different, individual material components. This averaging condition plays an important role in the effectiveness of use of the present invention, and this role is one which the reader will find fully described and discussed in the above-mentioned '761 patent.

In a system and methodology of the type just above generally outlined and suggested, the tile structure of this invention is designed to direct microwave radiation into the human anatomy (at completely innocuous levels regarding any damage threat to tissue, body fluids, or bone) in such a fashion that it will effectively engage a volumetric space within the body wherein there are at least two, different (boundaried) anatomical materials, each characterized by a different dielectric constant, which materials co-contribute, in the above-mentioned "averaging" manner, to the "effective", apparent "uniform" (or nominal homogeneous) dielectric constant of the whole space. As is explained in the '761 patent, by so designing the tile structure of the present invention and its operation to engage the mentioned at-least-two-material volumetric space inside the anatomy, the likelihood that a weapon, or an article of contraband, will, by the nature of its own dielectric constant, and/or its specific configuration and shape, and/or its precise location and/or disposition relative to the human body, "fool" the invention by masquerading as a normal and expectable anatomical constituent, is just about nil. Preferably the "penetration depth" of this internal anatomical space is about 2½-wavelengths of the system operating frequency as measured mechanically in material having the mentioned "normal" dielectric constant.

If and when a foreign object, such as a weapon, or a contraband object, is borne by a person, for example closely against the outside the body, the presence of this object will, therefore, and does, change the average dielectric constant of the material content of the volume of space (anatomy, of course, included) which is occupied, in a very non-normal-anatomical, and detectable, manner, by the mentioned microwave radiation. Definitively, the presence of such non-expected (non-anatomical physiologic) material significantly changes the average value of the effective, average and apparent, uniform, spatial dielectric constant, in accordance with the averaging phenomena just mentioned above, and creates a situation wherein a distinctly different-than-expected dielectric signature appears as a responsive result of microwave scanning transmission in accordance with the invention. This scanning or screening process is referred to herein as being a practice of substance-scanning differentiation between physiology and non-physiology.

Further describing important distinctions that exist between prior art conventional practice, and practice performed in accordance with the tile structure of the present invention, whereas conventional scanning systems are designed to look for and "identify" a rather large number of specific objects and materials (substances), the approach taken according to the present invention is based upon examining human physiology for physiologic irregularities/abnormalities which are not expected to be part of the usual human, physiologic, dielectric signature (within a range of course) that essentially all people's bodies are expected to produce. As a consequence of this quite different approach for scanning, the system and methodology practiced by the tile structure of this invention are significantly more efficient, and quicker, in terms of identifying weaponry, contraband, etc. problem situations. Any out-of-norm physiologic signature which is detected produces an alarm state, which state can be employed to signal the need for security people to take a closer look at what the particular, just-scanned subject involved might have on his or her person.

In this systemic and operational setting, the present invention specifically relates to a unique plural-transceiver, integrated, modular tile structure (tile) which includes plural, compactly stacked, piggybacked circuit boards (panels) or layer structure, in one of which are homogeneously molded, in a row and column matrix fashion, an array of common-material, microwave transceiver body structures. Appropriate circuitry (transceiver-function operational circuitry) generally described herein, and implementable in numbers of different ways which are well within the skill of those generally skilled in the relevant art, electrically interconnects the circuit boards, and functions to control and drive the operations of the transceivers in simultaneous transmission and reception modes of operation. The transceivers (also called antennae) are densely organized to contribute significantly to overall structure compactness. The transceivers in a tile are arranged in a defined row-and-column pattern which is important to operation, and when two tiles are brought into appropriate side-by-side adjacency this pattern forms an appropriate operational pattern continuum across the two tiles. A useful arrangement of the tiles indeed involves organizing plural tiles themselves into a row-and-column array, and such an array has been determined to be quite effective in a structure desired to "scan", for example, airline boarding passengers.

According to an illustrative manner of utilizing the invention, for example in the setting of an airport, a kiosk-like unit is provided into which a party to be scanned steps through an open, subject entry-way which is defined by a pair of spaced opposing upright panels, each of which carries an array of integrated, self-contained tile structures, or tiles, each including combined, coaxial microwave transmitters and receivers (transceivers). These two panels effectively define an always open and exposed through-passage through the region between them, which region is referred to herein as a scanning zone, or chamber. These panels also define what is referred to herein as a panel-orientation-determined path for the passage of a person through the scanning zone. A complete scan of a human subject takes place in two stages, with, in one stage, these panels being located on one set of opposite sides of the body, such as on the left and right sides of a person, and in the other stage, the panels being disposed in a quadrature-related condition (having been rotated ninety-degrees) to perform a second scan which is taken along the two orthogonally related body sides, such as the front and rear sides of the person. Between these two scan orientations, the panels are rotated (as was just noted) through a ninety-degree arc, and in each of the two scanning positions, there is essentially no relative lateral motion which takes place between the panels and the subject standing between them.

A special processing feature of the illustrated system employing the present tile structure invention, with respect to the handling and scanning of large numbers of people, such as must be handled at airport security locations, is that the illustrated system allows for the creation, essentially, of two, generally orthogonally related lines of people waiting to be scanned, with successive people who are scanned entering the scanning zone, one after another, and alternately, from the heads of each of the two orthogonally related lines. A person to be scanned initially faces the scanning zone with a clear (see-through) view into (and through) that zone between the two panels.

With the person in place in the scanning zone, and disposed relatively stationary within that zone, the first scanning phase takes place to examine, sequentially, the laterally opposite sides of that person. This scanning phase is implemented by a special pattern of high-speed energizations of tile-borne transceivers organized into arrays in the panel-carried tiles of the present invention.

When such a first scanning phase is completed, and it is completed in a very short period of time, typically about 8-milliseconds, structure supporting the two tile-carrying panels rotates these panels through an arc of ninety-degrees, and stops them in the second scanning position relative to the subject, wherein the front and rear sides of the person are similarly scanned sequentially under a circumstance similar to that just described where the panels, and the subject between them, are again relatively fixed in positions with respect to one another.

The second scanning operation completes the scan process for the single subject now being discussed, whereupon that subject turns a corner to the right or to the left (this is illustrated in the drawings) depending upon which is considered to be the exit side from the scanning zone, and exits through the now-rotated, open (see-through) space between the two panels. The panels with the tiles of this invention are now positioned orthogonally with respect to the positions that they held when the first person just described was to be scanned, and the lead person in the orthogonally related other line of people now enters the scanning zone from the orthogonal location of that other line. Scanning of this next person takes place in much the same fashion just above described, except for the fact that, when the panel structure rotates through an arc of about ninety-degrees to perform the second scan of this "next" person, it effectively counter-rotates back to the position which it initially held in preparation for the previously explained scanning of the first person mentioned above. Scanning data is appropriately computer acquired from all scanning phases (two per person).

From the scanning data which is gathered with respect to each scanned person, that data is compared to a "map" or "schedule" of appropriate, physiologic, dielectric data relating to someone with a body type, height and weight similar to that of the person specifically being scanned, and any notable, dielectric-signature-related abnormalities cause an alarm state to be created which causes security people, for example, to call the particular subject aside for further and more focused scanning inspection. No photographic imagery is developed from any scanning data. Rather, one of the output qualities of scanned data includes the presentation, on a simple wire-form human anatomy shape, of one or more highlighted general anatomic areas that show where a detected abnormality resides. This presentation of data is easily readable and assessable with little personnel-interpretive activity required. Output data may also be presented in a somewhat grid-like, or checkerboard-like, field of light and dark patches whose lightnesses and darknesses are interpretable to indicate the presence of a detected dielectric, non-physiologic abnormality. This scanning process is fully described in the '761 patent and in the mentioned, prior-filed patent application.

Greatly facilitating a scanning operation as just described is the important compact and self contained transceiver tile structure of the present invention. As has been mentioned generally above, and as will be seen, this compact tile structure is formed with plural compactly stacked circuit board structures, the "front" one of which includes a generally planar body having molded into it the principal body portions of a plurality of transceivers organized into an orthogonally disposed row-and-column arrangement. While different specific organizations may be employed in accordance with practice of the invention, that which is illustrated herein as a preferred embodiment results in a cube-like tile structure having perimeter dimensions of about 10-inches by about 10-inches, and a stack depth, including three circuit boards, of about 2-inches or less. Extending from the fronts of the transceiver main bodies are elongate cylindrical stacks of parasitic elements. Preferably these elements are shrouded in the overall tile structure by an appropriate, radiation-transparent covering which gives the entire assembly of a tile a "cube-like" appearance.

As will become apparent and understood from the construction of the tile structure of this invention, an array of tiles, such as the arrays which are employed in the illustrative system described herein to demonstrate and explain use of the invention, can be assembled simply by bringing pairs of tile structures into side-by-side lateral adjacency with their "corners" aligned, and no matter which way a tile is oriented in the array, there will result what can be thought of as a tile functional continuum with respect to the appropriate operations of the transceivers in each tile. In other words, a very expansive array of transceivers can be assembled utilizing the tiles of the present invention based upon functional modularity which exists in the tiles, and which permits the tiles to be brought together in a fashion whereby it is not necessary that specific tile edges be brought into contiguity with specific edges of other adjacent tiles. Substantially any edge-to-edge aligned abutment will work appropriately.

Other features and advantages that are offered by the tile structure of the present invention will become more fully apparent as the description which now follows is read in conjunction with the accompanying drawings.

DETAILED DESCRIPTION OF THE INVENTION

Figure 1:
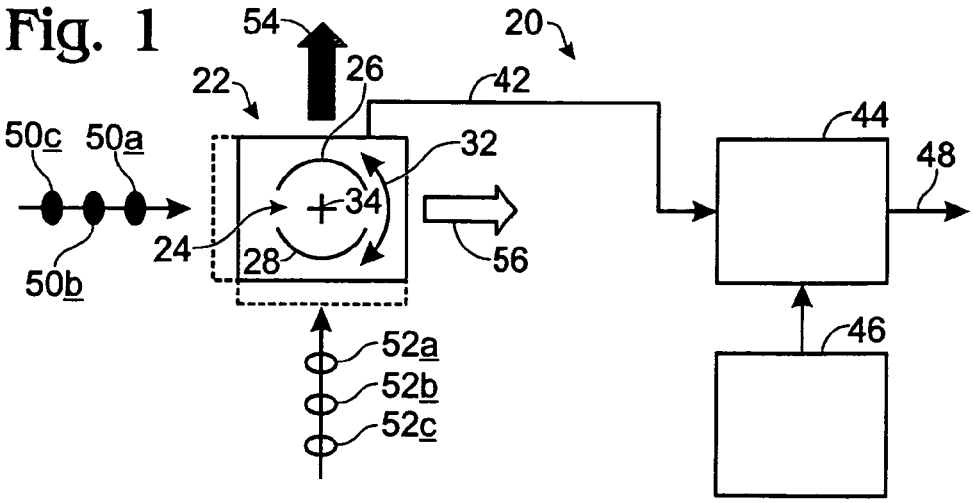
FIG. 1 is a simplified block/schematic diagram of a physiologic, dielectric scanning system which utilizes an organization of plural, integrated, microwave transceiver tile structure each constructed in accordance with a preferred embodiment of the present invention.
Figure 2:
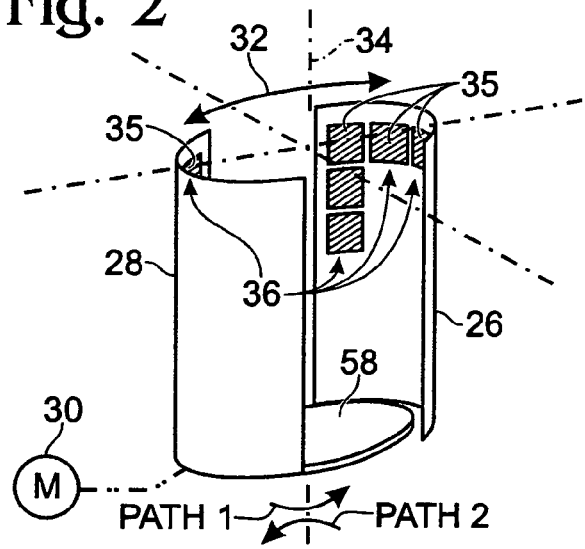
FIG. 2 is a simplified and stylized isometric view of a pair of ninety-degree counter-rotative, microwave, transmitters/receiver-tile-unit panels which define opposite sides of a kiosk-like scanning zone, or chamber, which is useful to perform dielectric personnel scanning employing the tile structure of the present invention.

Turning attention now to the drawings, and referring first of all to FIGS. 1 and 2, indicated generally at 20 is a dielectric, physiologic scanning/screening system built to include an arrangement of integrated transceiver tile structures made in accordance with a preferred embodiment of the present invention. The tile structure of this invention is particularly described herein in the setting of system 20 because of the fact that such a system offers an excellent illustration of the invention's utility.

Included in system 20 is a special kiosk-like unit 22 which includes what is referred to herein as a scanning, or screening, zone (or chamber) 24 that is specifically defined as a space between a pair of upright, curvilinear panels 26, 28. These panels (also referred to herein as "scanning" panels) are appropriately mounted for orthogonal (ninety-degrees only), reversible counter-rotation under the influence of a drive motor 30, back and forth (as indicated by double-ended, curved arrow 32) about an upright axis 34 which extends upwardly centrally through the scanning zone. Axis 34 extends substantially normal to the plane of FIG. 1.

As will be more fully described shortly, each of panels 26, 28 carries, in three vertical columns extending from top to bottom along the panel, plural arrays of combined, microwave transceivers (later to be described) which form portions of integrated tile structures 35 that are constructed in accordance with the present invention. The preferred embodiment for each such tile structure as illustrated herein takes the form generally of a rectangular (square) cube, through non-square and even non-rectangular shapes are certainly possible, if desired. Portions of four of such vertical columns of "tiles" are shown at 36 in FIG. 2. Several tiles 35 within these arrays are indicated.

Appropriate microwave functional operational circuitry which is associated with the behaviors of transceivers 35 will also be described later. As will be explained, preferably, the operating frequency of the system, with respect to microwave activity, is 5.5-Gigahertz—an operating frequency which has been found to work especially well with respect to scanning for normal physiologic dielectric signatures of the human body. As will be seen, the sizings of components within tiles 35 "flow" from the selection of this operating frequency. Considerations regarding this "sizing" of components are fully described in various ones of the above-referred-to prior background patent and patent-application documents.

Scanning output data is furnished, as is indicated by line 42 in FIG. 1, to a suitably programmed digital computer 44 which operates in association with an appropriate library of selectable, normal, human-subject, baseline, physiologic dielectric signatures, represented by a block 46 to furnish an alarm output signal on a line 48 when any defined signature abnormality is detected. Library 46 contains appropriate schedules, maps, etc. containing pre-established information regarding the selected range of human-body builds, physiologies, etc., that one wishes to profile for scanning purposes. Such information is freely designable by the user of the system and methodology of this invention. Its specific design is not a part of the present invention.

Still considering what is shown in FIG. 1, three large black dots 50*a*, 50*b*, 50*c*, represent three people in a line of people waiting to enter chamber 24 from the left side of kiosk 22 in FIG. 1. Similarly, three large clear dots 52*a*, 52*b*, 52*c*, represent three of the people in another line of people awaiting scanning and screening within zone 24, with this other line being disposed substantially in an orthogonal relationship with respect to the first-mentioned line of people. Two large arrows, including a darkened arrow 54 and a clear arrow 56, represent exit paths from chamber 24 for the people, respectively, who enter chamber 24 from the lines containing representative people 50*a*, 50*b*, 50*c*, and 52*a*, 52*b*, 52*c*, respectively. In other words, each person who enters from the line at the left of FIG. 1, in a direction which is generally from the left to the right in FIG. 1, will, after full, two-phase scanning has taken place, exit chamber 24 in the direction of arrow 54. Similarly, each person who enters chamber 24 from the line pictured on the bottom side of kiosk 22 in FIG. 1 will, after completion of a scanning operation, exit the scanning zone as indicated by arrow 56. Thus, each person who enters and exits zone 24 for scanning follows generally an orthogonal path through kiosk 22. At no time during any part of a scanning procedure is a person fully enclosed in chamber 24. Two diametrically opposite sides of the chamber, between the adjacent, upright edges of panels 26, 28, are always open. The two different orthogonal paths followed by alternate people being scanned are shown by labeled (PATH 1 and PATH 2) arrows in FIG. 2.

With panels 26, 28 positioned as specifically shown in FIGS. 1 and 2, these panels are arranged to allow the scanning zone to receive the first person who is standing in the line represented by blackened dots 50*a*, 50*b*, 50*c*. Such a person enters zone 24, through one of the two, open subject entrances to the zone, whereupon a first scanning phase is implemented under circumstances with that person, and panels 26, 28, relatively fixed in positional relationships with respect to one another. On completion of the first scanning phase for that person, then, under the control of motor 30, panels 26, 28 are rotated, for example, ninety-degrees counterclockwise so that they become positioned orthogonally relative to the positions shown for them in FIGS. 1 and 2. Following this repositioning of the panels, a second scanning phase is performed which, in the organization now being described, is a phase that scans the front and rear sides of the person who has entered zone 24 from the left in FIG. 1. Again, during the specific scanning, or screening, operation (simultaneous microwave transmission and reception), the relative positions of the person in zone 24 and panels 26, 28 is substantially fixed. In other words, scanning, takes place under circumstances where the transceiver tiles carried by the panels are not moving laterally in relation to the person being scanned.

With completion of this two-phase scanning operation just described, panels 26, 28 are now disposed in such a fashion that they expose zone 24 for straight-ahead entry into the zone by the first person in the line of people represented below kiosk 22 in FIG. 1 by the large clear dots. Scanning is performed for this person in much the same fashion just described, after which, that person exits the scanning zone as indicated by arrow 56.

In addition to the scanning operation performed by the transceiver tiles carried by panels 26, 28, three other data-gathering operations take place with regard to everyone who is scanned in chamber 24. An appropriate weight scale or sensor is provided in a standing platform 58 (see FIG. 2) which forms the base of chamber 24. Further, additional dielectric scanning devices (not specifically shown) are provided underneath platform 58 for the purpose of "looking" upwardly into chamber 24 to gather scanning information regarding the foot and shoe regions in chamber 24. Additionally, the height of each person scanned in the chamber is determined, as was outlined earlier, at the conclusion of the first scanning phase associated with that person.

Personnel scanning, per se, as well as the additional scanning and data-gathering structure (for weight, shoes and feet), associated with chamber 24 do not form part of the present invention, and can be completely conventional in nature. The above-mentioned patent application fully describes the scanning process.

Figure 3:
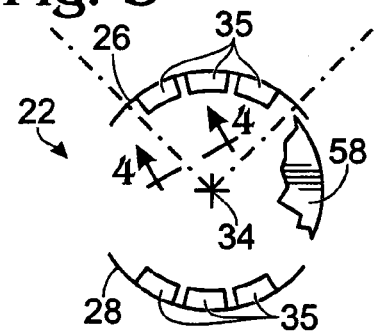
FIG. 3 is a simplified and stylized plan view looking downwardly into the scanning zone, or chamber, pictured in FIG. 2.

Considering now all of the drawing figures, each columnar array 36 of tiles 35 is formed of eight vertically stacked tiles, and thus system 20 includes forty-eight tiles. The vertical columns of tiles in each panel are slightly angled relative to one another, as can best be seen in FIG. 3. The lateral width of the three deployed columns of tiles in each panel is about 30-inches.

Figure 5:
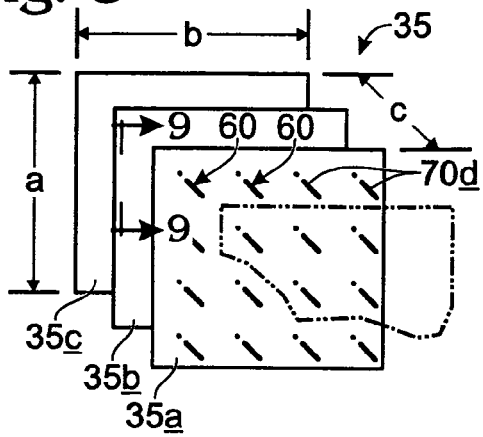
FIG. 5 is a simplified and somewhat stylized, exploded view illustrating the organization of a single tile structure made in accordance with a preferred embodiment of the invention and employed in the arrangement pictured in FIG. 4.
Figure 9:
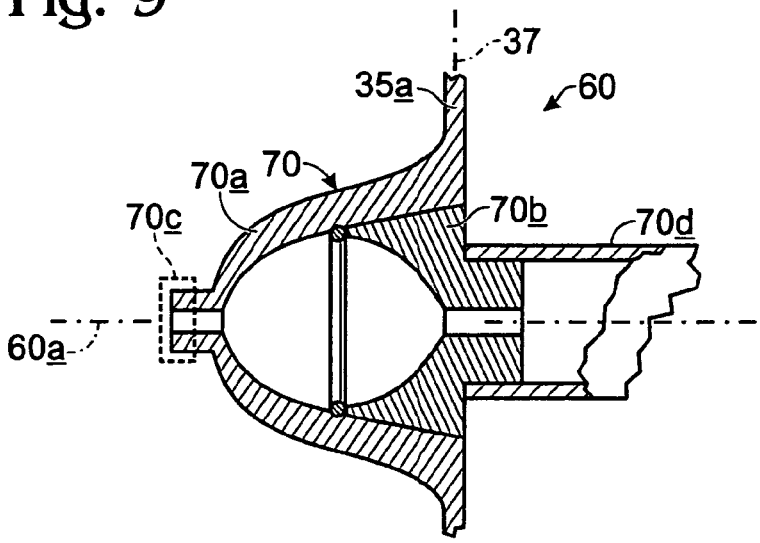
FIG. 9 is an enlarged and fragmentary view taken generally along the line 9-9 in FIG. 5 illustrating common-material integration between different portions of that part of the tile structure of the present invention which contains the array of transceivers.

Each tile 35 is formed in what is referred to herein as an assembled stack of circuit boards, or circuit-board portions. Specifically, this stack includes three circuit board portions 35*a*, 35*b*, 35*c*. Portion 35*a* is effectively in front of portion 35*b*, which is effectively in front of board portion 35*c*. Board portion 35*a* forms part of what is referred to herein as a first circuit-board planar structure. The nominal plane of board portion 35*a* is shown at 37 in FIGS. 9 and 11. Board portions 35*b*, 35*c* collectively form portions of what is referred to herein as a second circuit-board planar structure. Each of these boards has lateral dimensions defined by perimetral edges each of which has a length of about 10-inches. These lateral dimensions are illustrated in FIG. 5 at a and b. The three circuit board portions in each tile are suitably arranged in the united stack with a stack depth which is shown at c in FIG. 5 of about 2-inches or less. Within each tile, circuit board portion 35*a* includes and specifically carries a row-and-column array of microwave transceivers, such as those generally pointed to in the figures at 60. Transceivers 60 include transmission/reception axes 60*a* which are substantially normal to previously mentioned circuit board portion plane 37. Circuit board portions 35*b* and 35*c* in each tile appropriately carry what is referred to herein as transceiver-functional operational circuitry employed to control the operations of the transceivers for individual activation simultaneously in signal transmission and signal reception modes of behavior. Further details with respect to how such simultaneous activity takes place can be found in various ones of the previously mentioned prior-patent and patent-application informational documents.

Figure 11:
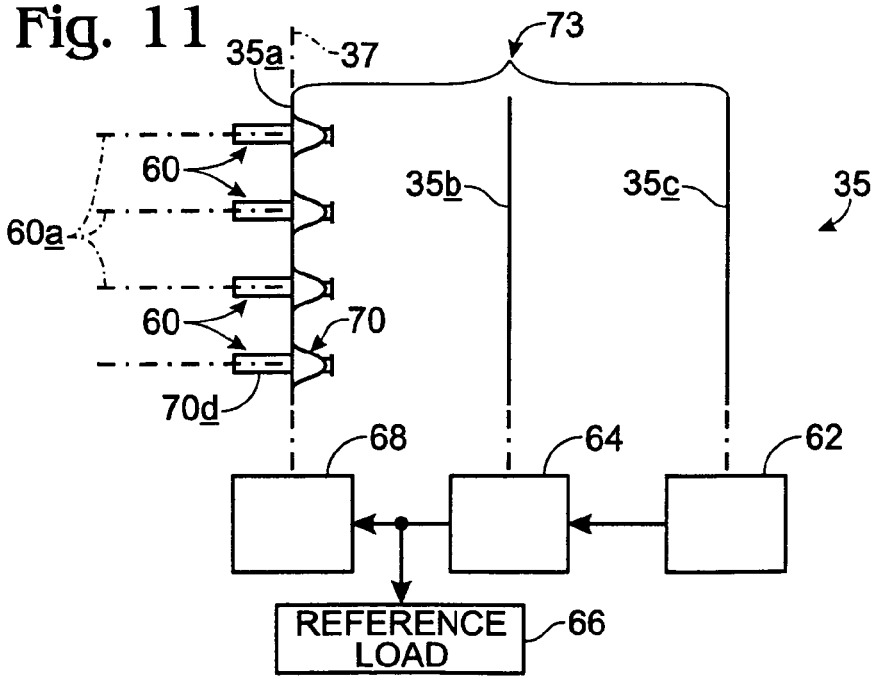
FIG. 11 is a block/schematic view illustrating a single tile structure made in accordance with the invention, and specifically illustrating generally the organization of functional control circuitry which is employed with the array of transceivers contained in that tile structure.

Generally speaking, the circuitry specifically associated with board portion 35*c*, represented by a block 62 in FIG. 11, includes a source of 5500-Gigahertz signal along with appropriate multiplexing circuitry. The circuitry carried by and associated with board portion 35*b*, represented by a block 64 in FIG. 11, includes high-speed switching circuitry which functions to distribute transmittable signals, one at a time, to the transceivers which form part of the mentioned first conductor-board structure. The circuitry represented by block 64 also, with respect to each transmission/reception simultaneous operation of each transceiver, sends signals to a single reference load which is represented by a block 66 in FIG. 11. High speed switching is accomplished preferably by the use of well known pin diodes, and the reference load contributes significantly to stability of transceiver operation under circumstances with ambient environmental conditions, such as temperature, changing over time. A block 68 in FIG. 11 represents circuitry employed in each board portion 35*a* directly to couple transmission and reception signal information to and from the individual transceivers. Details of circuitry form no part of the present invention, and are neither described nor illustrated in detail herein. Such circuitry can be constructed in a number of different ways well known to those generally skilled in the relevant art. Reference here may also be made to various ones of the mentioned prior art background documents for suggestions about useful circuitry approaches.

Figure 4:
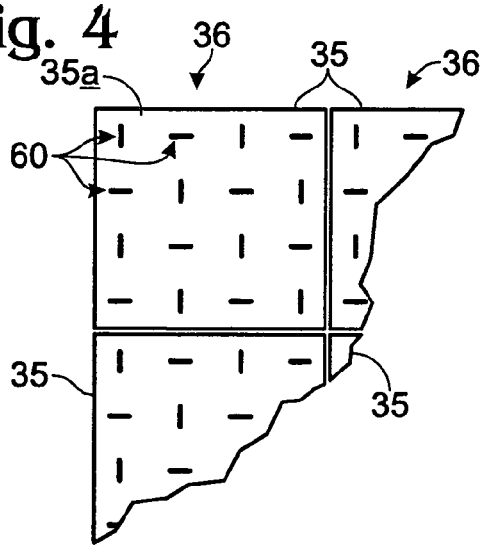
FIG. 4 is a simplified view taken generally along the line 4-4 in FIG. 3 illustrating an arrangement of plural tile structures constructed in accordance with the present invention and disposed in what is referred to herein as abuttingly and matchingly edge-to-edge and corner-to-corner confrontation. This figure also employs short, side-by-side, alternately orthogonally drawn lines to describe the respective operating directional polarities of adjacent transceivers in tiles.
Figure 6:
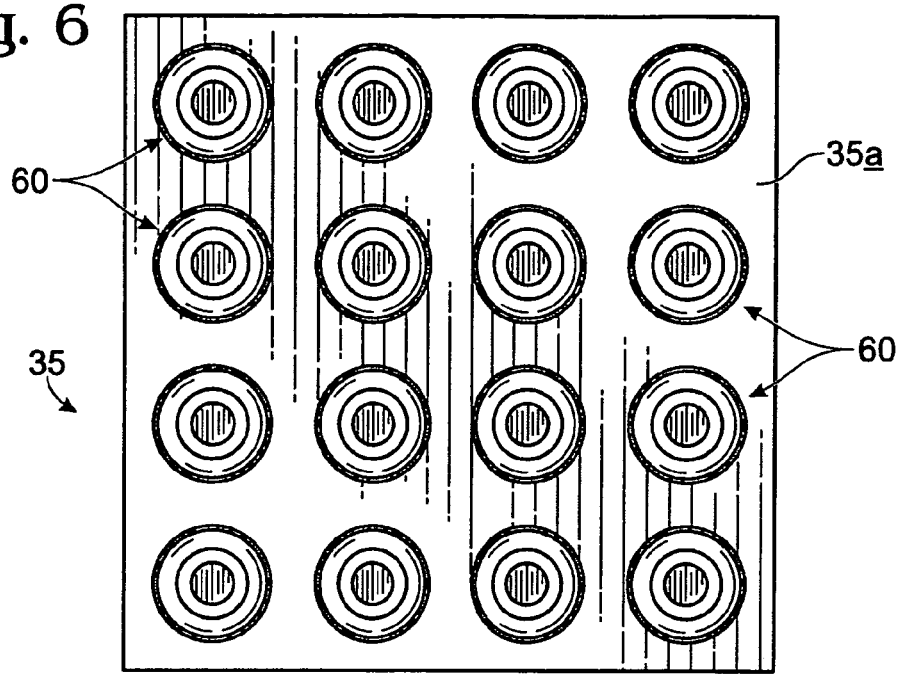
FIG. 6 is a view of what can be thought of as being the transceiver side, or face, of the tile structure pictured in FIG. 5.
Figure 7:
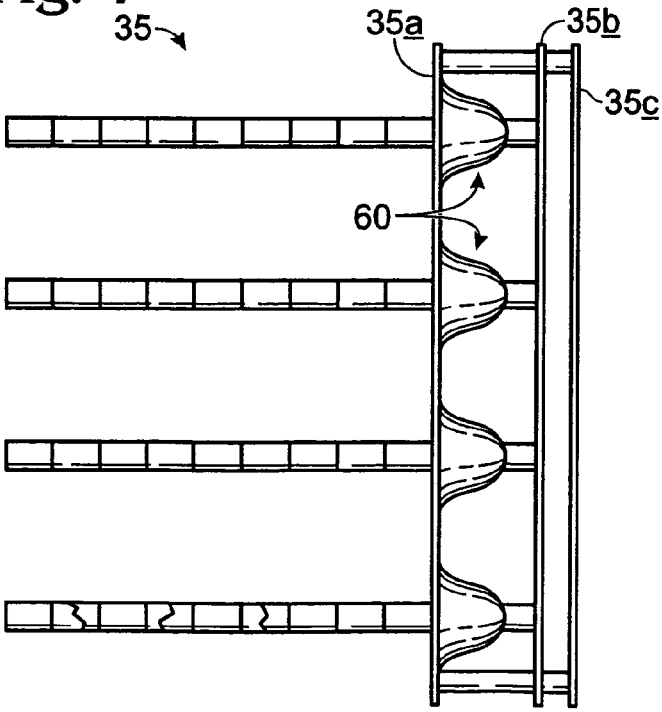
FIG. 7 is a view taken generally from the right side of FIG. 6.
Figure 8:
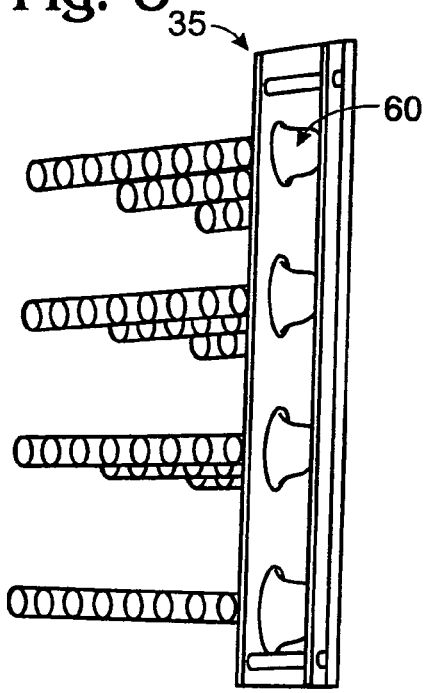
FIG. 8 is similar to FIG. 7, except that it is taken with a slight angle of rear perspective.
Figure 10:
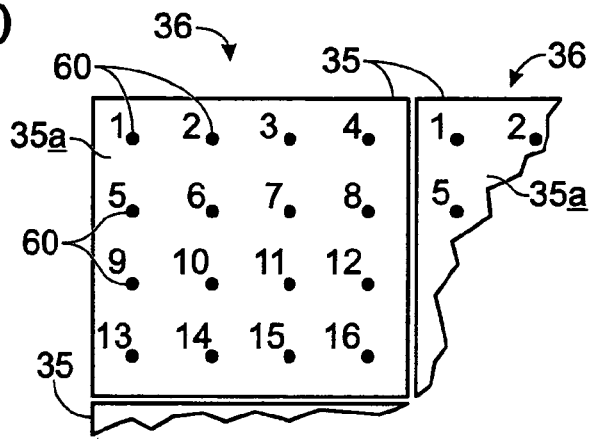
FIG. 10 is a fragmentary view illustrating three side-by-side-arranged tile structures constructed in accordance with the present invention labeled with Arabic numbers to describe a pattern of transmission/reception individuated operation of different ones of the respectively included transceivers.

As can be seen especially well in FIGS. 4, 5, and 10, and also in FIG. 6, included in each tile 35 is a row and column array of sixteen transceivers 60 which are organized along horizontal and vertical row-and-column lines that are orthogonal with respect to one another as viewed, for example, in FIGS. 4, 5, 6 and 10. What can be seen especially well in FIGS. 4 and 10 is the fact that, because of the way in which each tile 35 is constructed, when two tiles are brought into appropriate edge-to-edge abutting relationship, with relevant corners of the tiles essentially meeting with one another, the row-and-column pattern provided in each tile for the transceivers becomes effectively an operational continuum with the row-and-column arrangement of the transceivers in adjacent tiles. This modular consideration is important in allowing one to assemble plural tiles made in accordance with the present invention in adjacency with respect to one another, and in a manner whereby there is a full continuum cross the joints between two tiles of the distribution pattern provided in each tile for the transceivers.

Each transceiver 60 includes a main body portion 70 which includes a specially shaped portion 70*a* that is formed by molding integrally with planar portions of circuit board portion 35*a*. Also included in each transceiver are a front closure plug 70*b* a circular, electrically driven element 72, a receiving reception conductive element 70*c*, and a forwardly extending tubular parasitic component 70*d* which extends outwardly from the front face of circuit board portion 35*a*. The specific configurations of transceivers 60 is fully described in above-referred to U.S. Pat. Nos. 4,878,059 and 4,949,094.

Integral formation of the main body portions of each transceiver with the planar portions of board portion 35*a*, as preferably by molding from a polystyrene material, offers the significant advantage that the transceivers can be generated accurately in a precision organized row and column fashion.

In a manner which will be well understood by those generally skilled in the relevant art, in each row and column of transceivers, the components of the transceivers are organized so that next adjacent transceivers are alternately horizontally and vertically polarized. This polarization scheme is clearly represented by the short orthogonally related, straight, dark lines appearing on the faces of three of the four tiles shown generally in FIG. 4.

During a scanning or screening operation employing the transceivers in the tile structures of this invention, the individual operating energizing pattern takes place in the order of the sixteen Arabic numbers which appear on the face of circuit board portions 35*a* as these are pictured in FIG. 10. In the operation of system 20, when the transceivers in each tile are activated in the order pictured in FIG. 10, the next tile to have its transceivers so activated will be the next below-adjacent tile, if there is such. When all of the transceivers in all of the tiles in a column of tiles 36 have been activated, activation then begins with the uppermost tile in the next adjacent column 36.

On a final note with respect to the description of structure herein, pictured as a lightly shaded fragmentary square 72 in FIG. 5, is an appropriate cover structure which shrouds and conceals the presences of transceiver components 70*d*. This shroud plays no other role with respect to tile structure constructed in accordance with the present invention.

There is thus disclosed a unique integrated microwave transceiver tile structure useful for scanning and screening purposes in a system like system 20. Each tile structure takes the form of a very compact arrangement, and lends itself readily to assembly in an array of plural tiles, such as the arrays which exist in the organizations of columns 36 in system 20. A bracket 73 presented in FIG. 11 represents connection of appropriate circuitry in the tile 35 which is pictured in FIG. 11 with previously mentioned computer 44.

Thus, proposed by the present invention is a significantly compacted modular array of row-and-column microwave transceivers uniquely body-molded (or otherwise formed, as common-material, integral portions of a planar circuit board element, or portion, which is densely stacked with appropriate operationally supporting circuitry carried on other circuit board portions.

Each assembled tile structure is essentially completely self contained except, for example, with respect to an appropriate external overall control computer.

As was mentioned earlier, the sizes of elements which make up the different parts in each tile structure herein are dependent principally upon the chosen operating frequency of signals to be employed. There are many different ways in which the operational circuitry components in a tile structure made in accordance with this invention can be designed, and different ones of the earlier mentioned background documents give excellent information about how effective circuitry can be created.

Accordingly, while a preferred embodiment of a tile structure made in accordance with this invention has been described and illustrated herein, and certain modifications suggested, other variations and modifications will certainly come to the minds of those skilled generally in the relevant art, and it is intended that the claims herein will cover all such variations and modifications.

I claim:

1. Integrated microwave transceiver, modular tile structure comprising a first, generally planar, circuit-board layer structure including a planar portion and an array of plural, integrally formed microwave transceivers having body portions arranged in a defined row-and-column pattern, each of said transceivers possessing an associated transceiver axis extending generally normal to the plane of said first layer structure, with the planar portion of said first circuit-board layer structure and the body portions of said plural transceivers being integrally molded of a common material, and at least a second, generally planar, circuit-board layer structure including transceiver-function operational circuitry operatively connected to said transceivers functional to promote operation of the transceivers simultaneously in transmission and reception modes of operation, said first and second layer structures collectively forming at least portions of a rectilinear, cube-like, three-dimensional configuration for the tile structure.

2. The tile structure of claim 1, wherein said transceivers lie along lines in said array that are generally orthogonal relative to one another, and relative to the cube-like configuration of the tile structure.

3. The tile structure of claim 1 which, as viewed generally along a transceiver axis, has elongate, rectilinear, perimetral edges terminating at corners lying between intersecting pairs of such edges, with the tile structure being such that, when two tiles structures are brought together and adjacent one another in a manner whereby an edge in one substantially abuttingly confronts an edge in the other in a predefined modularity manner, the transceivers in each tile structure form a row-and-column pattern-continuum with the transceivers in the other, adjacent tile structure.

4. The tile structure of claim 1 which, as viewed generally along a transceiver axis, has elongate, rectilinear, perimetral edges terminating at corners lying between intersecting pairs of such edges, with the tile structure being such that, when two tiles structures are brought together and adjacent one another in a manner whereby an edge in one substantially abuttingly and corner-matchingly confronts an edge in the other in a predefined modularity manner, the transceivers in each tile structure form a row-and-column pattern-continuum with the transceivers in the other, adjacent tile structure.

5. The tile structure of claim 1 which, as viewed generally along a transceiver axis, has elongate, rectilinear, orthogonally related, perimetral edges terminating at corners lying between intersecting pairs of such edges, with the tile structure being such that, when two tiles structures are brought together and adjacent one another in a modularity manner whereby an edge in one substantially abuttingly and corner-matchingly confronts an edge in the other, the transceivers in each tile structure form a row-and-column pattern-continuum with the transceivers in the other, adjacent tile structure.

6. The modular tile structure of claim 1, wherein said first and second circuit-board layer structures collectively take the form of an assembled stack of plural, stack-aligned circuit board portions.

* * * * *